United States Patent [19]

Rude

[11] Patent Number: 4,729,418

[45] Date of Patent: Mar. 8, 1988

[54] TRUNNION AND BRACKET FOR ROLLERS

[75] Inventor: Edward T. Rude, Fairfield, Conn.

[73] Assignee: General Clutch Corp., Stamford, Conn.

[21] Appl. No.: 926,652

[22] Filed: Nov. 4, 1986

[51] Int. Cl.[4] ..... A47H 1/13

[52] U.S. Cl. ..... 160/323.1; 248/267

[58] Field of Search ..... 248/267, 268, 207, 266; 160/323 R, 323 B, 325, 326, 324

[56] References Cited

U.S. PATENT DOCUMENTS

| | | | |
|---|---|---|---|
| 1,133,360 | 3/1915 | Casper | 248/268 |
| 1,386,468 | 8/1921 | Goldner | 248/268 |
| 4,009,745 | 3/1977 | Erpenbeck | 160/326 X |
| 4,096,904 | 6/1978 | Donofrio | 160/326 X |
| 4,538,785 | 9/1985 | Damsgaard | 248/268 |

FOREIGN PATENT DOCUMENTS

| | | | |
|---|---|---|---|
| 2634103 | 2/1978 | Fed. Rep. of Germany | 248/268 |
| 1463183 | 11/1965 | France | 160/23 R |

*Primary Examiner*—David L. Talbott

*Attorney, Agent, or Firm*—Gottlieb, Rackman & Reisman

[57] ABSTRACT

A universal trunnion and bracket system for shade rollers in which the bracket is aligned with the centerline of the roller. The trunnion is rotatably mounted in an end of the roller. A lug, offset from the centerline of both the trunion and the roller, protrudes from the trunnion. The bracket has several (usually three) slots with tapered sides to match the tapered sides of the lug. The roller is mounted to the bracket by lowering the end of the roller until the lug engages a slot in the bracket, the non-circular shape of the lug and the slot preventing rotation of the trunnion with respect to the bracket.

6 Claims, 8 Drawing Figures

TRUNNION AND BRACKET FOR ROLLERS

DESCRIPTION

This invention relates to brackets for mounting axially rotatable tubes, and more particularly to brackets for mounting roller shades such as those used for covering windows. Brackets of this type are usually used in pairs, one of which must be capable of reacting torque and the other of which serves simply as a trunnion. Mounting of the roller to the first bracket is commonly achieved by axial movement to engage a projection, which is often an axial projection either on the bracket or the roller, with a mating feature on the other. Mounting to the trunnion bracket is then achieved by lowering the second, trunnion end of the roller, until a feature on that end of the roller engages a mating feature on the trunnion bracket. This invention relates to the second bracket regardless of whether it is the torque carrying or the idler bracket. The roller is normally retained in the brackets only by the force of gravity, the engaging feature on the roller at the trunnion end being so oriented that disengagement requires lifting the end of the roller. Frequently, each different mounting circumstance, e.g., trunnion end to the left, trunnion end to the right, mounting on a wall, mounting to the ceiling, ect., requires a bracket with a different configuration to provide the correct orientation of the engagement feature at the trunnion end of the roller relative to its bracket.

The prior art includes bracket designs intended to reduce the number of different styles that are required to meet all mounting circumstances. One arrangement that has often been used to provide universality for left and right hand wall as well as ceiling installations is to have three different engagement features on the second bracket so that one feature will always be oriented correctly. This method has two disadvantages. The bracket must be larger in order to accommodate the three engagement features; this adds to its cost and is aesthetically undesirable. The second disadvantage, that the roller centerline does not coincide with the centerline of the bracket, requires that the second bracket be mounted at a different height than the first bracket, or that the first bracket have three corresponding features. Another prior art solution to the problem employs an additional part at the interface of the roller and the bracket which can be installed in several different ways to provide the required orientation of the engagement feature while maintaining the alignment of the bracket and roller. An additional piece is always disadvantageous because of both cost and additional difficulty in handling and installation.

It is an object of the present invention to provide an improved trunnion-end bracket which can be used in left, right, wall or ceiling installations.

Another object of the present invention is to provide a trunnion-end bracket such that the center line of the roller and the center line of the bracket are aligned for each possible orientation of the bracket.

Still another object of the present invention is to provide a design for a bracket in which, while the roller is rotating, there is no relative motion between the bracket and the feature on the trunnion end of the roller that engages the bracket. This is desirable because, when relative motion exists between the roller and the trunnion bracket, frictional forces can cause the roller to become disengaged from the bracket.

Still another object of the present invention is to provide a design for a bracket onto which the roller can be easily mounted even when the installer cannot see the bracket or the end of the roller.

Most prior art window shade rollers have a gudgeon pin which protrudes from one end of the roller for engagement with a slot or a hole in the bracket. During rotation of the roller the pin rotates in the bracket. In the present invention, the bracket engaging element does not rotate. Instead, the bracket engaging element remains stationary and the roller is rotatably mounted to it. With this arrangement, it is no longer necessary to locate the interface between the bracket engaging element and the bracket on the centerline of the roller because no rotation takes place at that interface. Moving the interface away from the centerline of the roller permits the bracket to be centered with respect to the roller centerline while still preserving mounting provisions for wall, ceiling, left hand end, or right hand end mountings.

Further objects, features and advantages of the invention will become apparent upon consideration of the following detailed description in conjunction with the drawings, in which.

Figure 2:
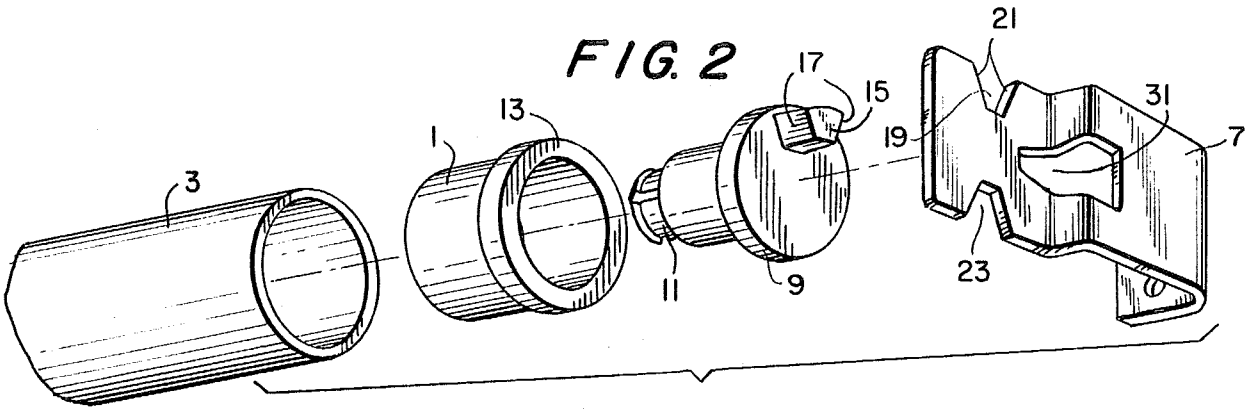
FIG. 2 is an exploded view of the system of FIG. 1.
Figure 1:
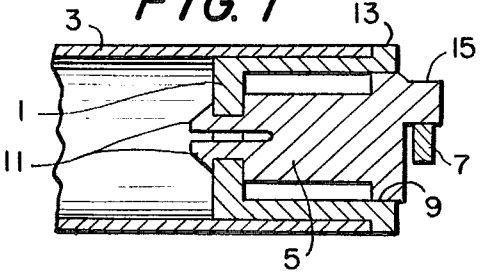
FIG. 1 is a cross-sectional view of the preferred embodiment of the roller, trunnion, and bracket.

Referring now to FIGS. 1 and 2, the preferred embodiment of the invention, trunnion 5 is rotatably mounted within housing 1, shoulder 9 being sized to turn freely within the inside diameter of housing 1. Snap in feature 11 permits trunnion 5 to be rotatably retained within housing 1 without the requirement of a fastener. The resulting trunnion end assembly is then inserted into roller 3 wherein it is retained by friction, shoulder 13 on housing 1 limiting the insertion depth of the assembly into roller 3. Lug 15 on trunnion 5 has two angled surfaces 17. When trunnion 5 engages bracket 7, angled surfaces 17 engage sides 21 of slot 19 on bracket 7, preferably without play between these two parts.

Figure 3:
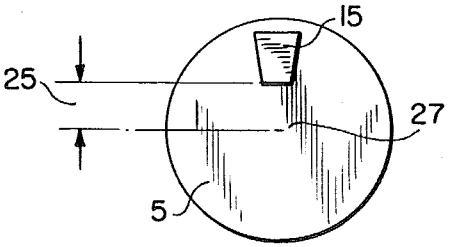
FIG. 3 is an end view of the trunnion.
Figure 4:
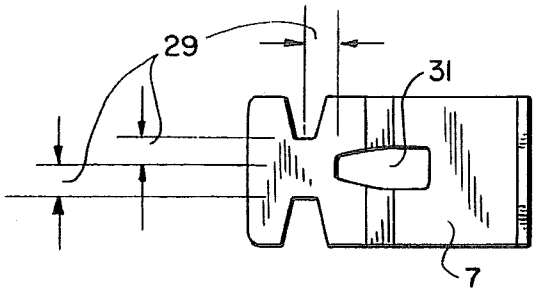
FIG. 4 is a side elevation of a portion of the bracket.
Figure 5:
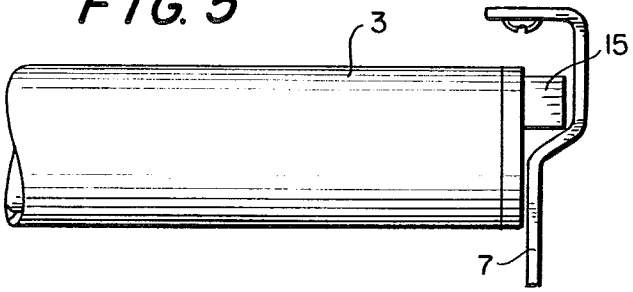
FIG. 5 shows a ceiling mounted bracket with the trunnion end of the roller in position for engagement with the bracket.
Figure 6:
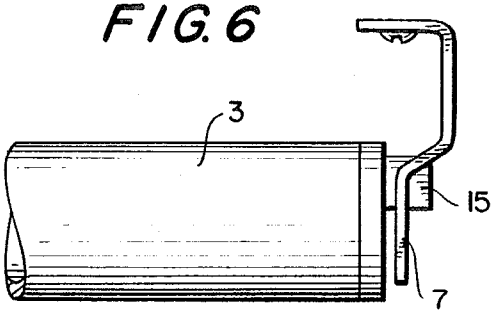
FIG. 6 shows the elements of FIG. 5 after the trunnion has engaged the bracket.

FIG. 2 shows bracket 7 oriented as for mounting to a vertical surface with the trunnion end of the roller on the right hand end. For an installation with the trunnion end of the roller on the left hand side, the same bracket can be mounted with slot 23 facing upward to engage lug 15. For an installation in which the bracket is mounted to a ceiling, as shown in FIGS. 5 and 6, lug 15 will engage slot 31. FIG. 5 shows lug 15 positioned for lowering into slot 31 which is the slot used for ceiling mounts. FIG. 6 shows the same components after mounting is complete and the roller has been lowered into position. In all cases, the axis of symmetry of the bracket intersects the axis of symmetry of the roller. FIG. 3 shows dimension 25 between the bottom of lug 15 and center 27 of trunnion 5 which is preferably equal to or slightly greater than dimension 29 which can be seen in three places in FIG. 4.

The bracket can be made with different numbers, arrangements, and orientations of slots to permit other desired combinations of mounting configurations. For mounting to surfaces at angles other than vertical or horizontal, the bracket would be appropriately configured so as to provide vertically opening slots for each of the desired mounting orientations.

It is possible to design a system in which the trunnion is mounted directly into the roller without the necessity for a separate housing piece. In that case the end of the roller could be formed to retain the trunnion, and the inside of the roller would form the bearing surface which rotates about the trunnion. However, there are several advantages to having a separate housing which mates with the roller and into which the trunnion is rotatably mounted. First, manufacturing tolerances for tubing make it difficult to guarantee a proper slip fit between a roller and a trunnion. Having the trunnion rotatably mounted within a housing helps to insure a good bearing fit between the trunnion and the housing while the housing can be configured to be somewhat tolerant of variations of the size of the tubing. Also, certain types of roller tubing have interior seams or other irregularities that would have to be removed if the inside surface of the roller were to be a satisfactory bearing surface. In addition, when molded plastic components are used, it is relatively inexpensive to produce different housings sized to fit various tubing sizes.

Mounting of the roller to the brackets is quite easy because the lug, being free to rotate within its housing, tends to center itself when it contacts any part of the bracket. The angled sides of lug 15 and slot 19 make mounting easier by providing easier entry of the lug into the slot.

Figure 7:
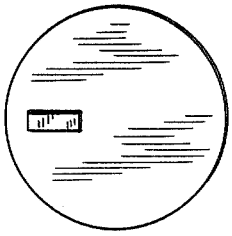
FIG. 7 shows an alternative configuration for the trunnion.

FIG. 7 shows an alternative embodiment, in which the lug is rectangular in cross-section. Such a lug will function perfectly well, but will be somewhat more difficult to install. Also, because clearance is required between the lug and the sides of the slot in the bracket to which it is mounted, the roller center will have some freedom of movement which may be undesirable.

Figure 8:
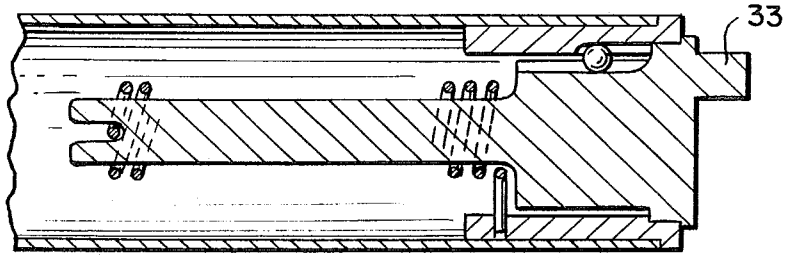
FIG. 8 shows yet another configuration in which the trunnion is on the motor end of the roller.

While the foregoing has described application of the invention to the idler ends of rollers, it will be apparent that the same configuration of bracket and trunnion can be used at the torque carrying end of a roller. FIG. 8 shows a conventional spring motor having lug 33 a part thereof. Lug 33 is offset from the axis of the roller. Clutches and other cord or chain operated mechanisms can also be designed with the spear offset from the roller axis for use with brackets of the type shown in FIG. 2.

Conventional gudgeon pin and bracket arrangements suffer from the disadvantage that one end of the roller must be supported on a rather small pin. Window shades that undergo frequent usage often fail due to wear failure of the pin. Our invention provides much larger bearing surfaces which can be optimized to reduce wear by appropriate choices of materials for the trunnion and the housing.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A bracket and trunnion means hardware pair for the trunnion end of a roller, said trunnion means being adapted for rotatable mounting into an end of said roller, a protruding lug displaced away from the centerline of said trunnion means for engaging said bracket to mount said roller, the cross-sectional shape of said lug being non-circular to impede rotation of said lug with respect to said bracket, said bracket having at least one slot for engaging said lug.

2. A bracket and trunnion means hardware pair in accordance with claim 1 in which said trunnion means includes a housing and trunnion insert therefor adapted for rotatable mounting within the housing, said housing being sized for fitting tightly into an end of a roller and said lug extending from the end of the said trunnion insert.

3. A bracket and trunnion means hardware pair in accordance with claim 1 in which said bracket has a mounting flange.

4. A bracket and trunnion means hardware pair in accordance with claim 1 in which said bracket has a first slot for engaging said lug when said bracket is mounted to a vertical wall and at one end of said roller and a second slot for engaging said lug when said bracket is mounted to a vertical wall and at the second end of said roller.

5. A bracket and trunnion means hardware pair in accordance with claim 4 in which the axis of symmetry of said bracket intersects the axis of symmetry of said roller when said lug is engaged by either of said slots.

6. A bracket and trunnion means hardware pair in accordance with claim 5 further incorporating a slot for engaging said lug when said bracket is mounted to a horizontal surface.

* * * * *